US006655115B1

(12) United States Patent
Zurlinden et al.

(10) Patent No.: US 6,655,115 B1
(45) Date of Patent: Dec. 2, 2003

(54) METHOD OF FORMING A SEAL OVER A CORK IN A NECKED BOTTLE

(75) Inventors: David Paul Zurlinden, Carmel Valley, CA (US); David Marc Zurlinden, Carmel Valley, CA (US); Malcolm Yuill-Thornton, Cotati, CA (US)

(73) Assignee: Patented Innovations, LLC, Cotati, CA (US)

( * ) Notice: Subject to any disclaimer, the term of this patent is extended or adjusted under 35 U.S.C. 154(b) by 34 days.

(21) Appl. No.: 09/705,459

(22) Filed: Nov. 2, 2000

Related U.S. Application Data

(63) Continuation-in-part of application No. 09/480,917, filed on Jan. 11, 2000, now Pat. No. 6,349,524, and a continuation-in-part of application No. 09/384,904, filed on Aug. 27, 1999, now Pat. No. 6,205,744.

(51) Int. Cl.[7] ..... B67B 5/00

(52) U.S. Cl. ..... 53/484; 53/485; 53/487; 53/359; 53/328

(58) Field of Search ..... 53/484, 485, 487, 53/341, 359, 328, 489, 264, 370.3

(56) References Cited

U.S. PATENT DOCUMENTS

| | | | | |
|---|---|---|---|---|
| 1,363,824 | A | * 12/1920 | Tait | |
| 2,013,304 | A | 9/1935 | Glunz | 53/319 |
| 2,811,002 | A | 10/1957 | Dimond | 53/342 |
| 3,067,552 | A | 12/1962 | Aubry | 53/420 |
| 3,133,389 | A | 5/1964 | Randrup et al. | 53/420 |
| 3,712,017 | A | 1/1973 | Knabe et al. | 53/319 |
| 3,720,559 | A | * 3/1973 | Odom et al. | |
| 3,771,283 | A | 11/1973 | Over et al. | 53/343 |
| 3,832,892 | A | 9/1974 | Bohl | 53/341 |
| 3,841,056 | A | 10/1974 | Vandrebeck | 53/341 |
| 3,936,991 | A | 2/1976 | Deix | 53/319 |
| 3,946,540 | A | 3/1976 | Solberg et al. | 53/341 |
| 3,961,463 | A | 6/1976 | Dimond et al. | 53/319 |
| 4,205,502 | A | * 6/1980 | Ahlers | |
| 4,771,588 | A | 9/1988 | Lofgren et al. | 53/319 |
| 4,803,031 | A | 2/1989 | Ochs et al. | 264/255 |
| 4,979,282 | A | 12/1990 | Alieri et al. | 425/809 |
| 4,984,415 | A | 1/1991 | Kuroda | 53/489 |
| 5,150,558 | A | 9/1992 | Bernhard | 53/343 |
| 5,261,547 | A | 11/1993 | Finke | 215/233 |
| 5,447,246 | A | 9/1995 | Finke | 215/233 |
| 5,449,080 | A | 9/1995 | Finke | 215/233 |
| 5,553,728 | A | 9/1996 | Finke | 215/233 |
| 5,654,022 | A | 8/1997 | Sayre | 426/118 |
| 5,904,886 | A | 5/1999 | Stecker | 264/255 |
| 6,007,315 | A | 12/1999 | Busacchi | 425/809 |
| 6,205,744 | B1 | 3/2001 | Zurlinden et al. | 53/341 |
| 6,341,472 | B1 * | 1/2002 | Schroeder | 53/485 |

OTHER PUBLICATIONS

U.S. patent application Ser. No. 09/480,917, Zurlinden et al., filed Jan. 11, 2000.

* cited by examiner

*Primary Examiner*—Eugene Kim
*Assistant Examiner*—Sameh H. Tawfik
(74) *Attorney, Agent, or Firm*—Townsend and Townsend and Crew LLP

(57) ABSTRACT

An apparatus and an automated method are disclosed by which embossed seals are created in the necks of corked bottles. A die is employed with an image bearing die surface. The bottle moves along an automated bottle track. Molten seal material is introduced into the cavity above the cork in the neck of the bottle. The image bearing surface of the seal embossing mechanism is superimposed over the mouth of the bottle containing the molten seal material. The seal embossing mechanism is centered relative to the top of the bottle. The die surface is extended from the seal embossing mechanism into contact with the surface of the molten seal material. The mechanism is motivated along an automated seal track coincident with the movement of the bottle along the automated bottle track with the image bearing die surface in contact with the molten seal material until the material has cooled so that the die impression will be retained by the sealing material. The image bearing die surface is then retracted.

7 Claims, 14 Drawing Sheets

METHOD OF FORMING A SEAL OVER A CORK IN A NECKED BOTTLE

This application is a continuation-in-part of and claims priority from U.S. patent application, Ser. No. 09/384,904, filed Aug. 27, 1999 now U.S. Pat. No. 6,205,744, and U.S. patent application, Ser. No. 09/480,917, filed Jan. 11, 2000 now U.S. Pat. No. 6,349,524, the disclosures of which are incorporated herein by reference in their entirety.

BACKGROUND OF THE INVENTION

The present invention relates generally to sealing corked bottles, and, more particularly, to automated methods and apparatus by which seals having high quality embossed images are formed in necked bottles.

Current methods for sealing the tops of corked bottles have various drawbacks. A common method involves the use of metal foils secured over the entire mouth and some of the neck of the bottle. Although this method provides a tamper resistant seal, the metal foils have been commonly made of lead, which has been shown to leave traces of the poisonous chemical on the glass surface of the mouth of the bottle. The more recent adoption of nontoxic metal foils has not been fully successful and better methods of sealing the neck of the bottle are still desired.

Another current method involves the insertion of a preformed thermoplastic disc in the cavity in the neck of the bottle above the cork. In order to create a seal over the cork, the neck of the bottle is heated to a point at which the thermoplastic material will melt. The heating of the bottle, especially to a temperature at which the thermoplastic disc will fully liquify, presents problems when the contents of the bottle are heat sensitive, such as wine. Additionally, the heating of the bottle may produce imperfections in the bottle's material, thus creating potential weak points in the neck of the bottle.

The present invention provides a means for creating an aesthetically pleasing seal over the corks of necked bottles without compromising the integrity of the bottle or its contents. Additionally, this method deals solely with thermoplastic materials which are safe if traces remain on the mouth of the bottle.

SUMMARY OF THE INVENTION

The present invention is directed to an apparatus and an automated method by which embossed seals are created in the necks of corked bottles. A die is employed with an image bearing die surface. The bottle moves along an automated bottle track. Molten seal material is introduced into the cavity above the cork in the neck of the bottle. The image bearing surface of the seal embossing mechanism is superimposed over the mouth of the bottle containing the molten seal material. The top of the bottle is centered relative to the seal embossing mechanism. The die surface is extended from the seal embossing mechanism into contact with the surface of the molten seal material. The mechanism is motivated along an automated seal track coincident with the movement of the bottle along the automated bottle track with the image bearing die surface in contact with the molten seal material until the material has cooled so that the die impression will be retained by the sealing material. The image bearing die surface is then retracted.

In the preferred embodiment of the present invention, the mouth of the bottle is generally centered below the seal embossing mechanism by lowering a cone shaped centering member over seal embossing mechanism the mouth of the bottle before the molten seal material is allowed to cool in the neck of the bottle. The seal embossing mechanism is then centered more accurately by inserting a circular centering piston into the mouth of the bottle. The die surface on which there is a die image is then lowered from the seal embossing mechanism into contact with the surface of the molten seal material. Contact between a seal embossing surface and the surface of the molten seal material is maintained while the bottle and a seal embossing mechanism are simultaneously motivated down the track. Contact between a seal embossing surface and the surface of the molten seal material is maintained for a period of time long enough to allow for the seal material to cool to a state in which the seal impression will be maintained.

In accordance with the preferred embodiment of the invention, the seal embossing mechanism for forming the embossed seal in the neck of the bottle includes an actuator guide block and a die holder coupled with the actuator guide block using an actuator spring. The die holder is moveable relative to the actuator guide block between a rest position and a compressed position. The actuator spring is compressed in the compressed position to bias the die holder toward the rest position. The die holder includes a die stem having a die support portion and a spring seat. A centering member may be coupled with the spring seat by an engagement spring, if necessary, and would thus be movable relative to the spring seat between a rest position and a compressed position.

The novel features which are characteristic of the invention, as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENTS

The preferred embodiment of the bottle sealing method and apparatus of the present invention employs a die having a die surface with a die image of a logo or design. The die surface is used to form a seal with a logo or design in a bottle cavity in the neck of the bottle over the cork. The seal is formed by first introducing an amount of molten seal material into the bottle cavity. The die having a die surface with a die image is then brought into contact with the molten seal material in the bottle cavity. The molten seal material cools while in contact with the die surface having a die image and thus an embossed surface is created on the upper surface of the seal material.

Figure 1:
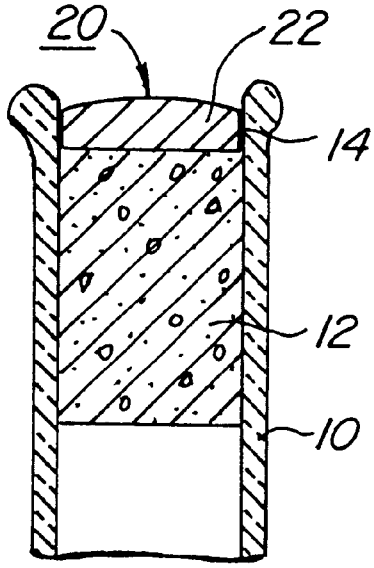
FIG. 1 is a cross-sectional view of a neck of a corked bottle which has been sealed with a thermoplastic material in accordance with the teachings of the preferred embodiment of the present invention.
Figure 2:
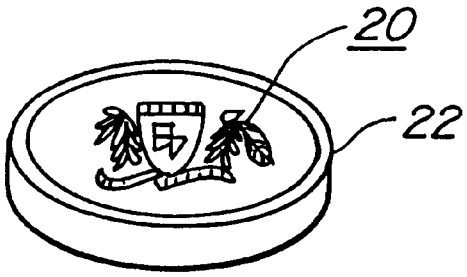
FIG. 2 is a perspective view of the seal of FIG. 1.

FIG. 1 illustrates a bottle neck 10 with cork 12 disposed therein. A seal 22 provided by the preferred embodiment of the method and apparatus of the present invention is disposed in a bottle cavity 14 in the bottle neck 10 above cork 12. The seal material is typically a thermoplastic material such as an organic polymer material, a synthetic thermoplastic material, or beeswax which melts when heated but which is a solid at room temperature. The top surface 20 of seal 22 facing outward and away from cork 12 is embossed to provide a design which is indicative of origin of the wine, or decorative, or both. FIG. 2 shows the seal material 22 with the embossed surface 20.

Bottle Sealing Apparatus

Figure 3:
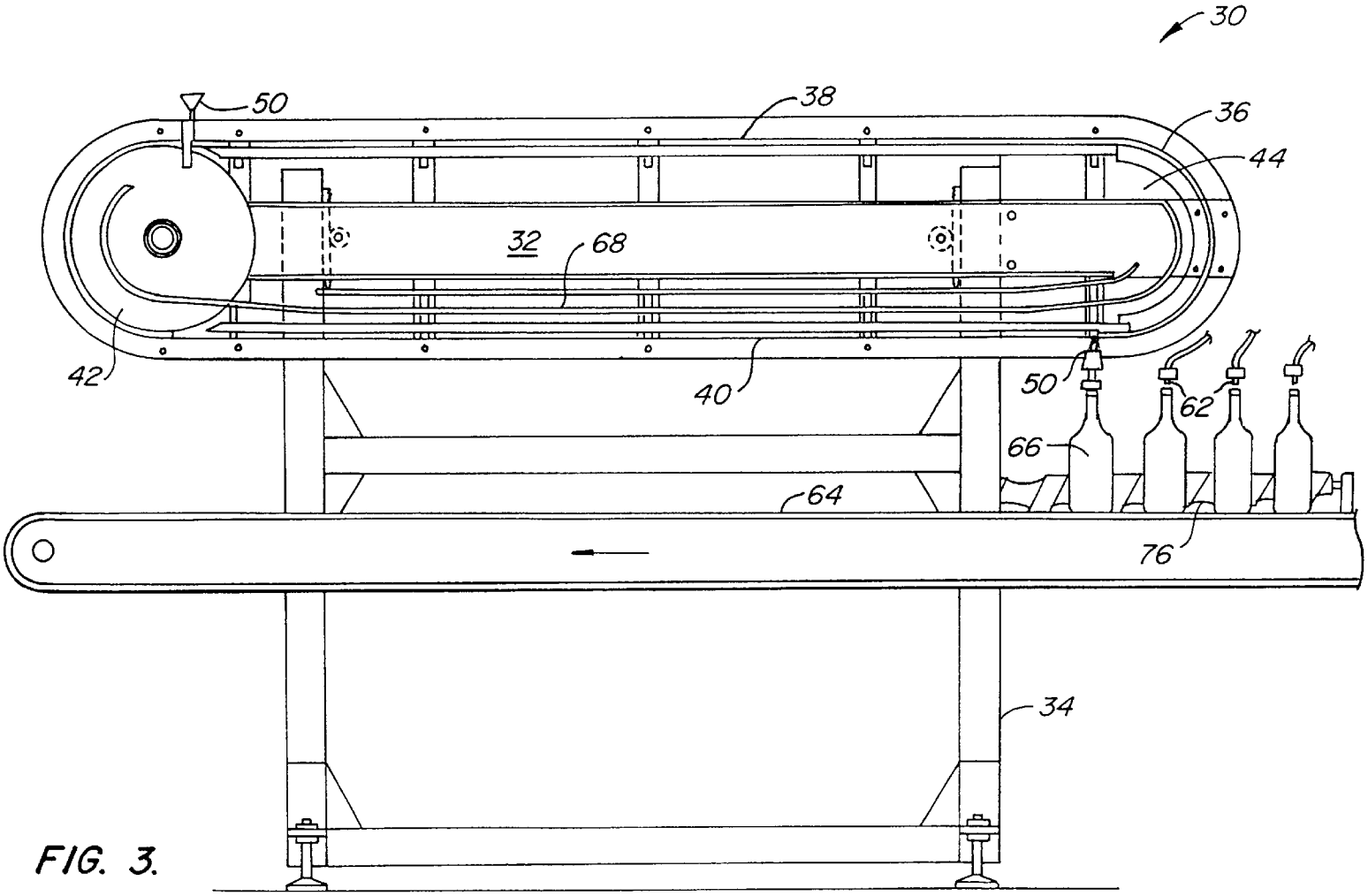
FIG. 3 is a front elevation view of a bottle sealing apparatus in accordance with an embodiment of the present invention.
Figure 4:
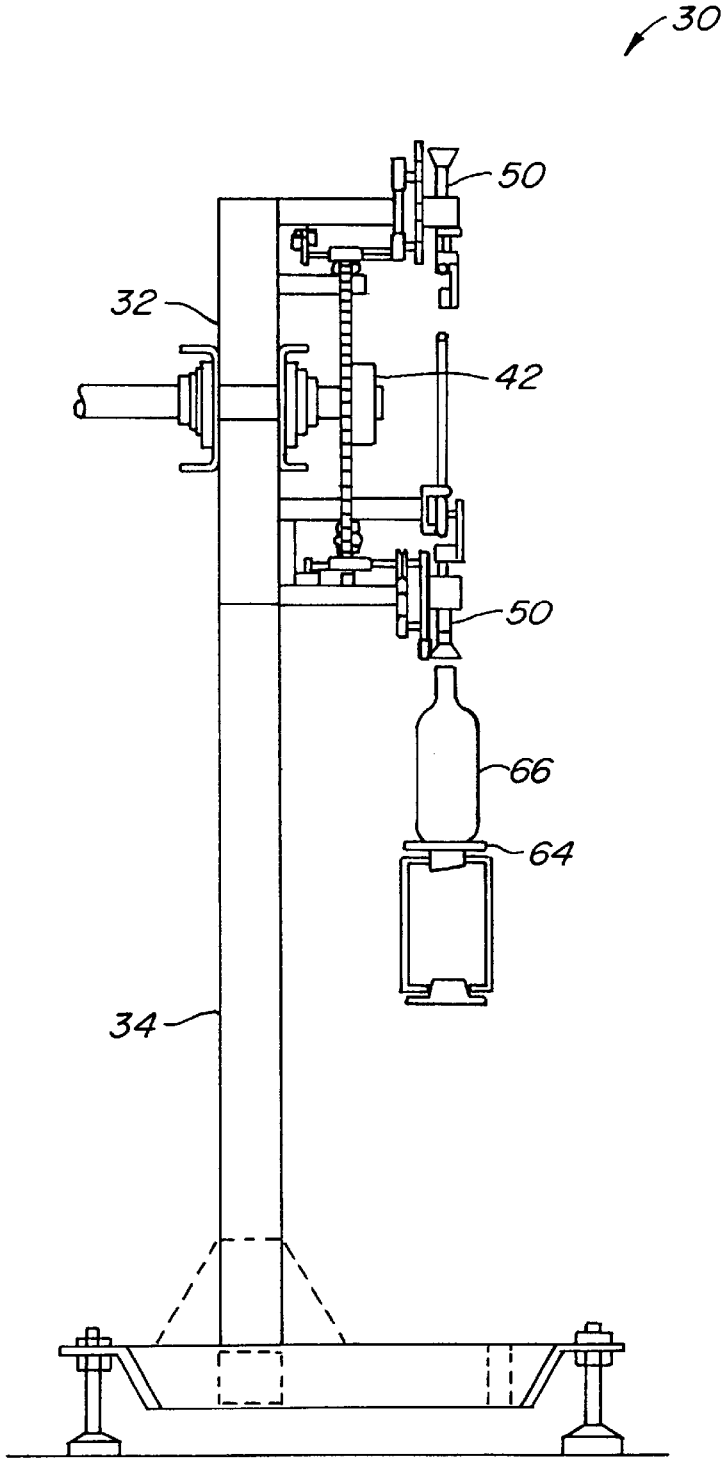
FIG. 4 is a side elevation view of the bottle sealing apparatus of FIG. 3.

FIGS. 3 and 4 illustrate the preferred embodiment of a bottle sealing apparatus 30 for sealing corked bottles by forming the seals 22 of FIGS. 1 and 2 in an automated process. Apparatus 30 includes an upper main support frame 32 connected with and supported above lower support frame 34. Mounted on upper support frame 32 is an endless drive chain 36, which travels along a path which includes a generally horizontal upper path portion 38 and a generally horizontal lower path portion 40 which are each generally straight. At the ends of path portions 38 and 40 chain 36 traverses a drive sprocket 42 and a guide sprocket 44 to form an oval-shaped carousel.

A plurality of die truck assemblies such as assembly 50 (only two are shown) are spaced along and coupled with endless drive chain 36, which is driven to move the die truck assemblies continuously in a clockwise direction in the front elevation view of FIG. 3. Each die truck assembly 50 includes a die cavity. Die truck assemblies 50 are desirably evenly spaced along endless drive chain 36. Die truck assemblies 50.are disposed with the die cavities oriented upward along upper path portion 38 of drive chain 36, and are disposed with the die cavities oriented downward along lower path portion 40.

A bottle conveyor 64 is provided below and disposed generally parallel to lower path portion 40 for conveying bottles 66 along a track in the same direction as die truck assemblies 50 along lower path portion 40. While bottles 66 move along conveyor 64, the speed of drive chain 36 is synchronized with the speed of conveyor 64 to generally align each die truck assembly 50 with the neck of one bottle. Upper support frame 32 includes a wheel track 68, as best seen in FIG. 3, which generally tracks the path of drive chain 36 for guiding assemblies 50. Wheel track 68 includes an offset portion along lower path portion 40 of drive chain 36. The offset portion is offset in the downward direction, thereby guiding the actuation portions of die truck assemblies 50 downward to engage with the necks of bottles 66 over a portion of travel of endless drive chain 36 along lower path portion 40.

Figure 5:
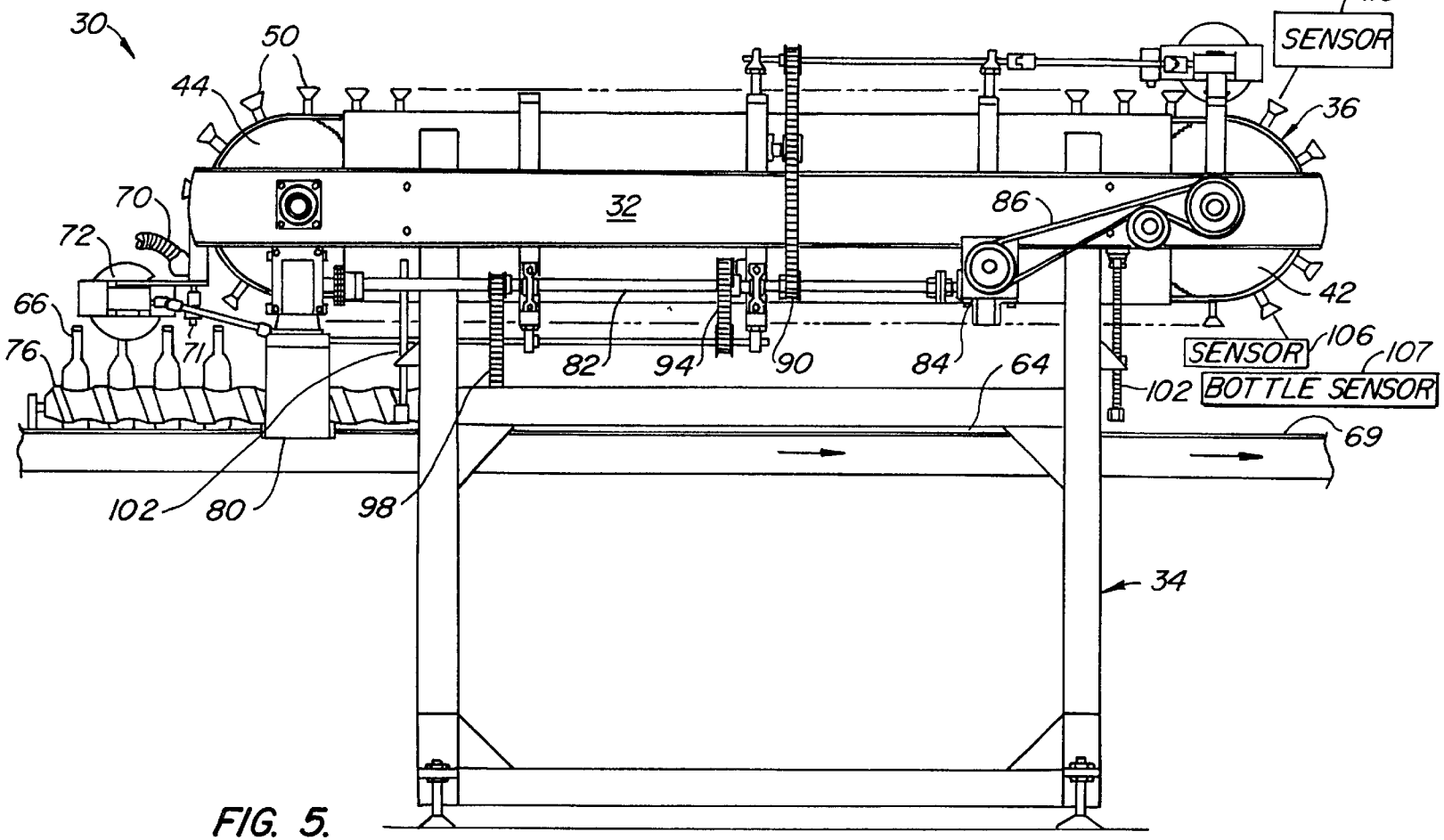
FIG. 5 is a rear elevation view of the bottle sealing apparatus of FIG. 3.

Prior to engaging die truck assemblies 50 with bottles 66, applicator 70 is provided near the start of lower path portion 40 for introducing an amount of molten seal material through nozzle 71 into the cavity in the neck of each bottle 66, as seen in FIGS. 3 and 5. A reciprocator 72 is desirably provided for cyclically moving applicator 70 to follow the movement of each bottle 66 for a deposition time and to introduce the molten seal material into the cavity of the bottle 66 during the deposition time period. Reciprocator 72 begins at a first position and moves applicator 70 to a position to maintain nozzle 71 of applicator 70 in general alignment with the cavity of bottle 66. Upon reaching the specified position, reciprocator 72 separates applicator 70 from bottle 66 and returns it to the first position to meet the next bottle 66 and begin the next cycle of reciprocating movement. The reciprocating motion can be generated by, for example, a rotating cam. In one embodiment, the deposition time is about 40–50 milliseconds for a travel distance of about 2 inches.

To ensure that the spacing between bottles 66 on conveyor 64 matches the spacing between die truck assemblies 50 on drive chain 36 for proper alignment and engagement of bottles 66 with assemblies 50, a bottle guide 76 is provided near the start of conveyor 64 to guide bottles 66 onto conveyor 64 with spacing which matches the spacing between assemblies 50. As best seen in FIGS. 3 and 5, the bottle guide in the embodiment shown is a timing screw 76 with a specific pitch. Rotating timing screw 76 advances bottles 66 and feeds them onto conveyor 64. The speed of rotation of timing screw 76 is synchronized with the speed of drive chain 36 to generally align the necks of bottles 66 as they travel on conveyor 64 with die truck assemblies 50.

As shown in FIG. 5, a single drive motor 80 is desirably provided for driving drive sprocket 42, reciprocator 72, and timing screw 76 in synchronism for forming seals 22 on bottles 66. Drive motor 80 is typically a variable speed motor, and rotates main drive shaft 82. Drive shaft 82 is coupled with gearbox 84 which is in turn coupled to sprocket drive belt 86 which drives drive sprocket 42 and drive chain 36 in rotation. The preferred embodiment employs a pair of horizontally spaced drive chains 36 which move in unison and provide a more secured connection with die truck assemblies 50 by coupling the two sides of assemblies 50. Main drive shaft 82 also drives reciprocator 72 through reciprocator drive belt 94 rotating a cam. Main drive shaft 82 further drives timing screw 76 through timing screw drive belt 98.

Drive belts 86, 90, 94, 98, and gearbox 84 preferably provide the proper rotational reductions and gear ratios so as to synchronize the movement and speed of drive sprocket 42, reciprocator 72, and timing screw 76. This ensures that timing screw 76 feeds bottles 66 with the same spacing to match those between die truck assemblies 50, and that reciprocator 72 moves applicator 70 at the same speed as each bottle 66 over the deposition time period. In this way, the process rate of the entire apparatus 30 can be easily changed by simply adjusting the speed of single drive motor 80 while preserving the synchronism of the various components.

In the preferred embodiment, apparatus 30 is easily adjustable to process bottles 66 of different heights. As shown in FIG. 5, drive chain 36, drive sprocket 42, applicator 70, reciprocator 72, and drive motor 80 are attached to upper support frame 32. Timing screw 76 and bottle conveyor 64 are attached to lower support frame 34. The vertical position of upper support frame 32 is adjustable relative to lower support frame 34 via a pair of jacking screws 102. The height adjustment of upper frame 32 varies the vertical spacing between die truck assemblies 50 and bottle conveyor 64, thereby adapting apparatus 30 to processing bottles 66 with different heights.

Die Truck Assembly

Figure 6:
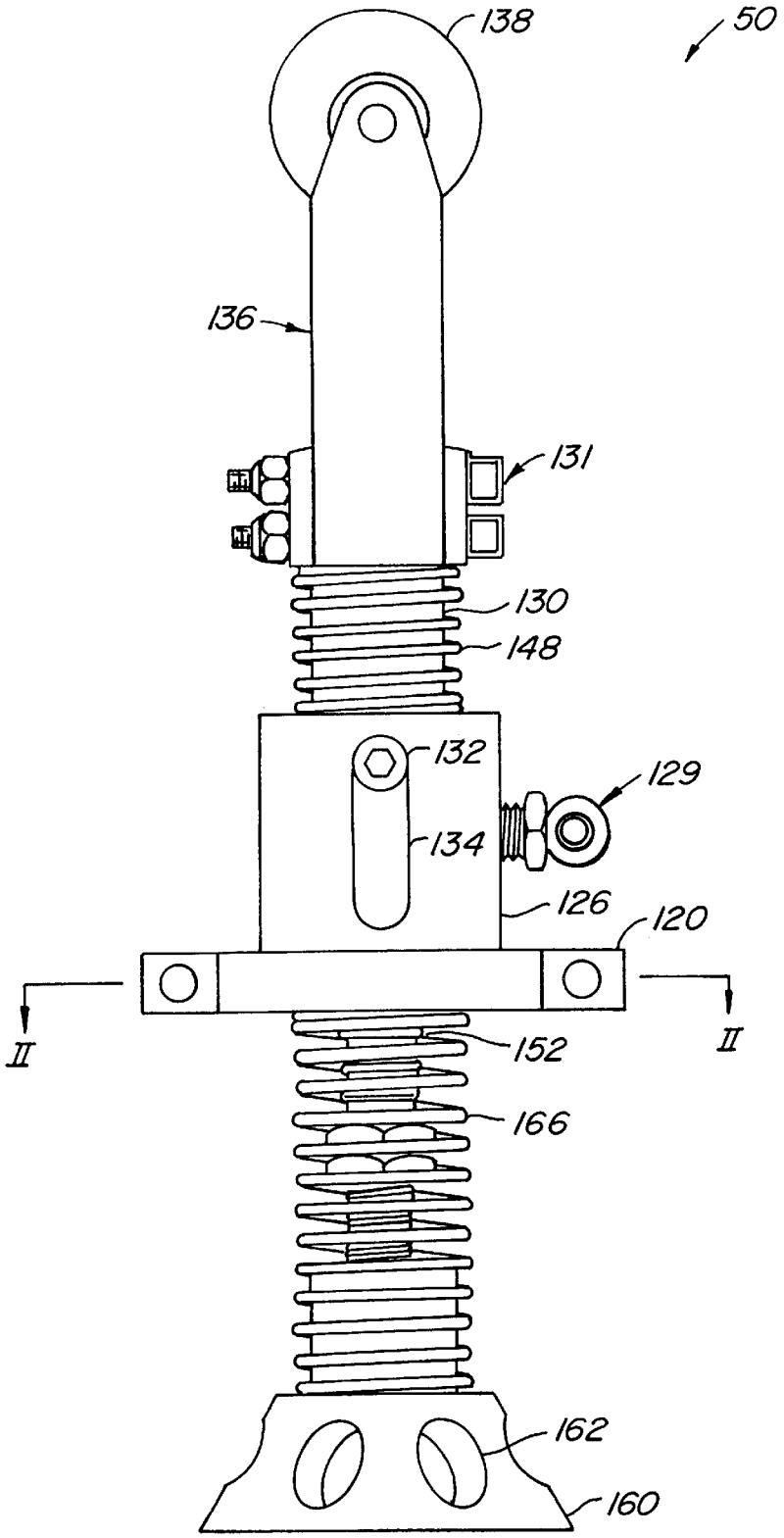
FIG. 6 is a front elevation view of a die truck assembly in accordance with an embodiment of the present invention.
Figure 7:
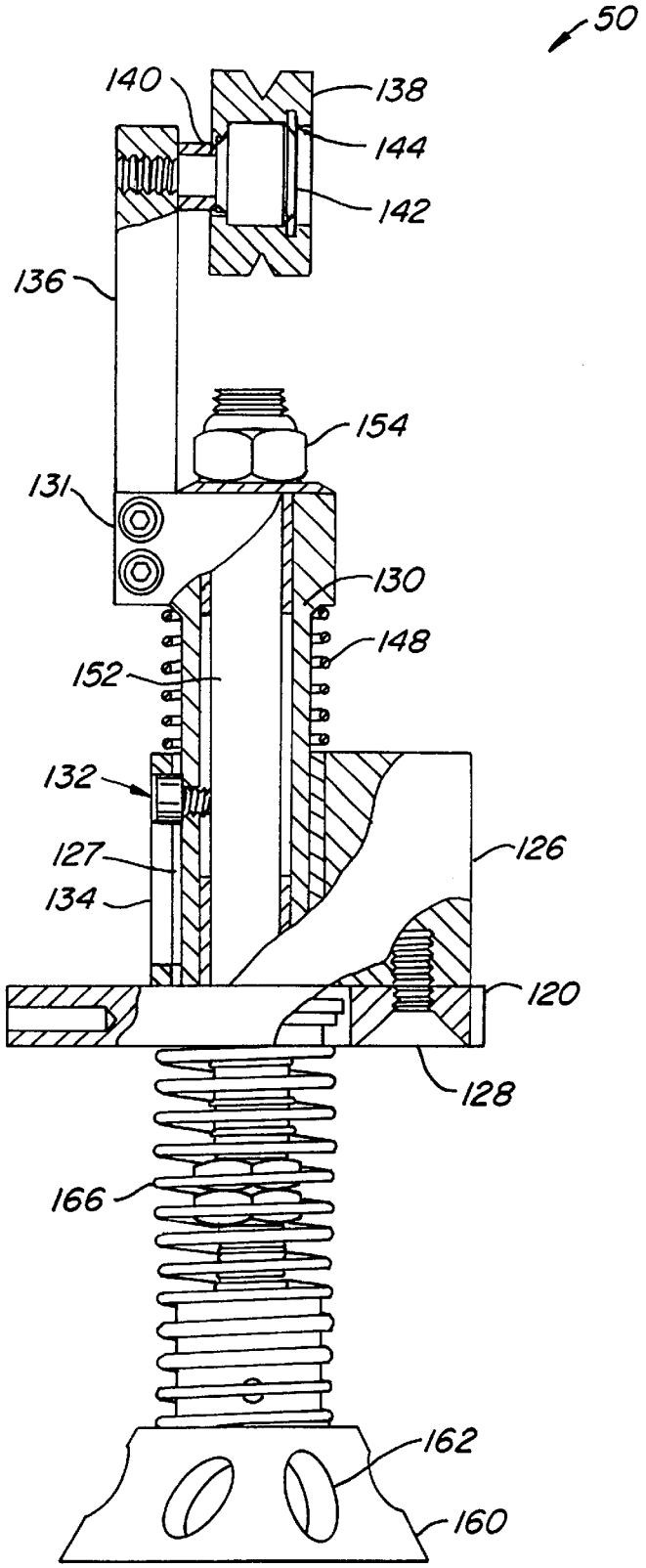
FIG. 7 is a side elevation view of the die truck assembly of FIG. 6 with partial cross sections.

FIGS. 6–15 show details of die truck assembly 50. Assembly 50 includes carrier plate 120 which is connected to drive chain 36. Carrier plate 120 includes a U-shaped recess 121 and a pair of holes 123. Actuator guide block 126 is generally fixed to carrier plate 120 by fastener 128 and includes grease fitting 129, as seen in FIG. 7. Actuator guide tube 130 is disposed through the opening 127 of guide block 126 and the U-shaped recess 121 of carrier plate 120. Guide pin 132 is connected to guide tube 130 and constrained to move generally vertically along guide slot 134 in guide block 126, thereby restricting the movement of guide tube 130 to the vertical direction relative to guide block 126 (FIGS. 6 and 7).

Figure 8:
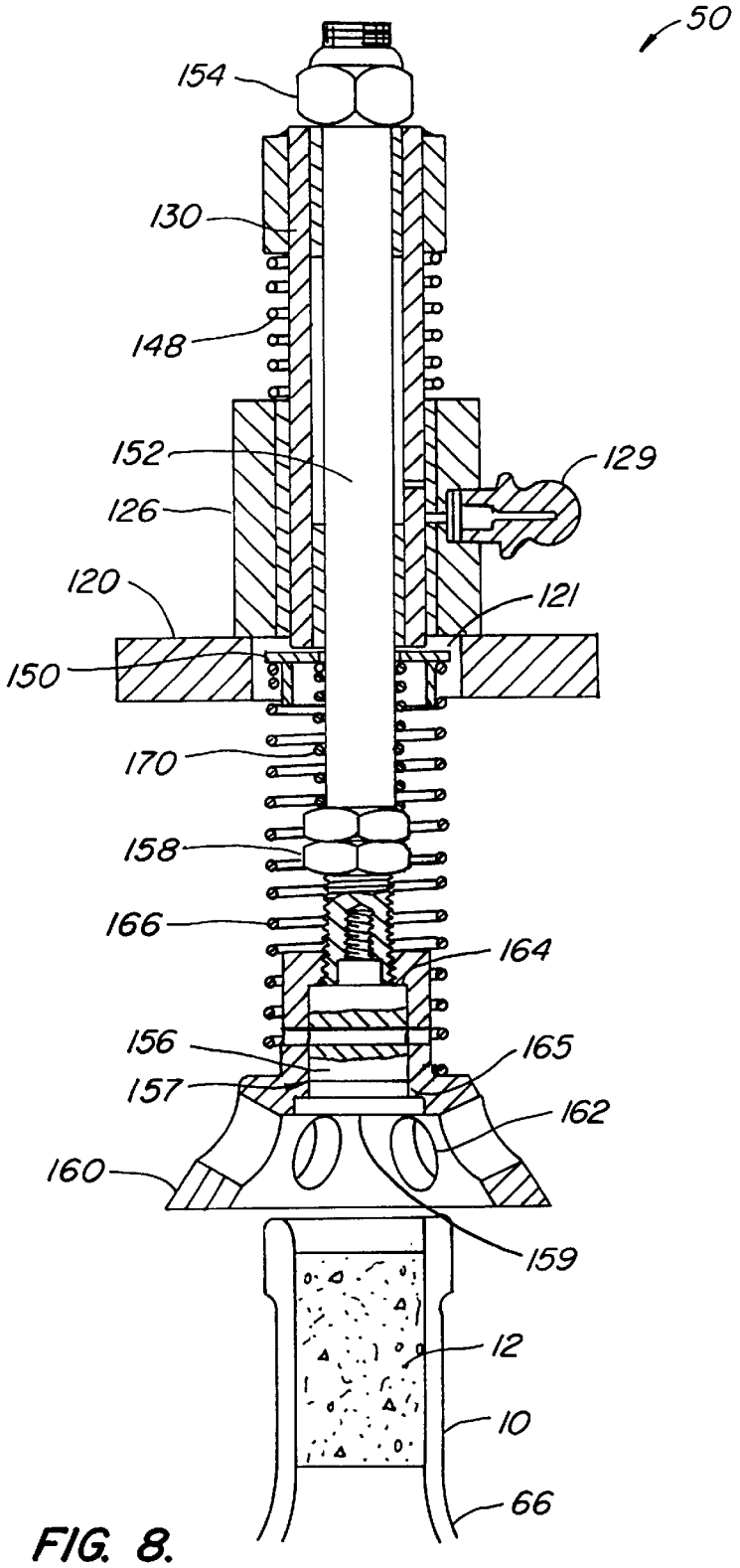
FIG. 8 is a cross sectional view of the die truck assembly of FIG. 6 taken along line I—I.

As best seen in FIGS. 6 and 7, wheel bracket 136 is coupled to the top of guide tube 130 by fasteners 131 at one end and to actuator wheel 138 at the other end through spacer 140. Inner wheel support 142 is coupled in the interior of wheel 138 by retainer clip 144. Wheel 128 is coupled with wheel track 68 and rolls on the wheel track as assembly 50 is driven by drive chain 38. As shown in FIGS. 6–8, actuator spring 148 is coupled between guide tube 130 and guide block 126, and is compressible from the rest position shown to allow guide tube 130 to move downward relative to guide block 126.

Spring seat 150 is attached to guide tube 130, as best seen in FIG. 8. Die stem 152 is disposed inside guide tube 130 and is slidable relative thereto generally in a vertical direction. Attached to the upper end of die stem 152 is stop 154 which defines the limit of downward movement of die stem 152 relative to guide tube 130. At the lower end of die stem 152 is die support portion 156 for supporting die 157 having a die surface 159 with a die image for forming embossed surface 20 on seal 22 (FIGS. 1 and 2). Die 157 is desirably made using a minting process which produces a high quality die with consistency and long life at a relatively low cost. Blocking member 158, shown in FIG. 8 as including a pair of jam nuts, is attached to die stem 152 and spaced below spring seat 150 by a distance. Guide tube 130 and die stem 152 form a die holder for supporting die 157. The movements of guide tube 130 and die stem 152 facilitate formation of embossed seal portion 16 in die truck assembly 50.

Centering member 160 is coupled with die stem 152 near die support portion 156 and is slidable generally vertically relative to die stem 152. Centering member 160 has a generally conical shape enlarging in a direction away from spring seat 150. As seen in FIG. 8, the conical inner surface of centering member 160 conveniently centers the cavity above cork 12 in neck 10 of bottle 66 with respect to die 157 of die truck assembly 50 when die stem 152 is moved downward to engage with the bottle.

Figure 12:
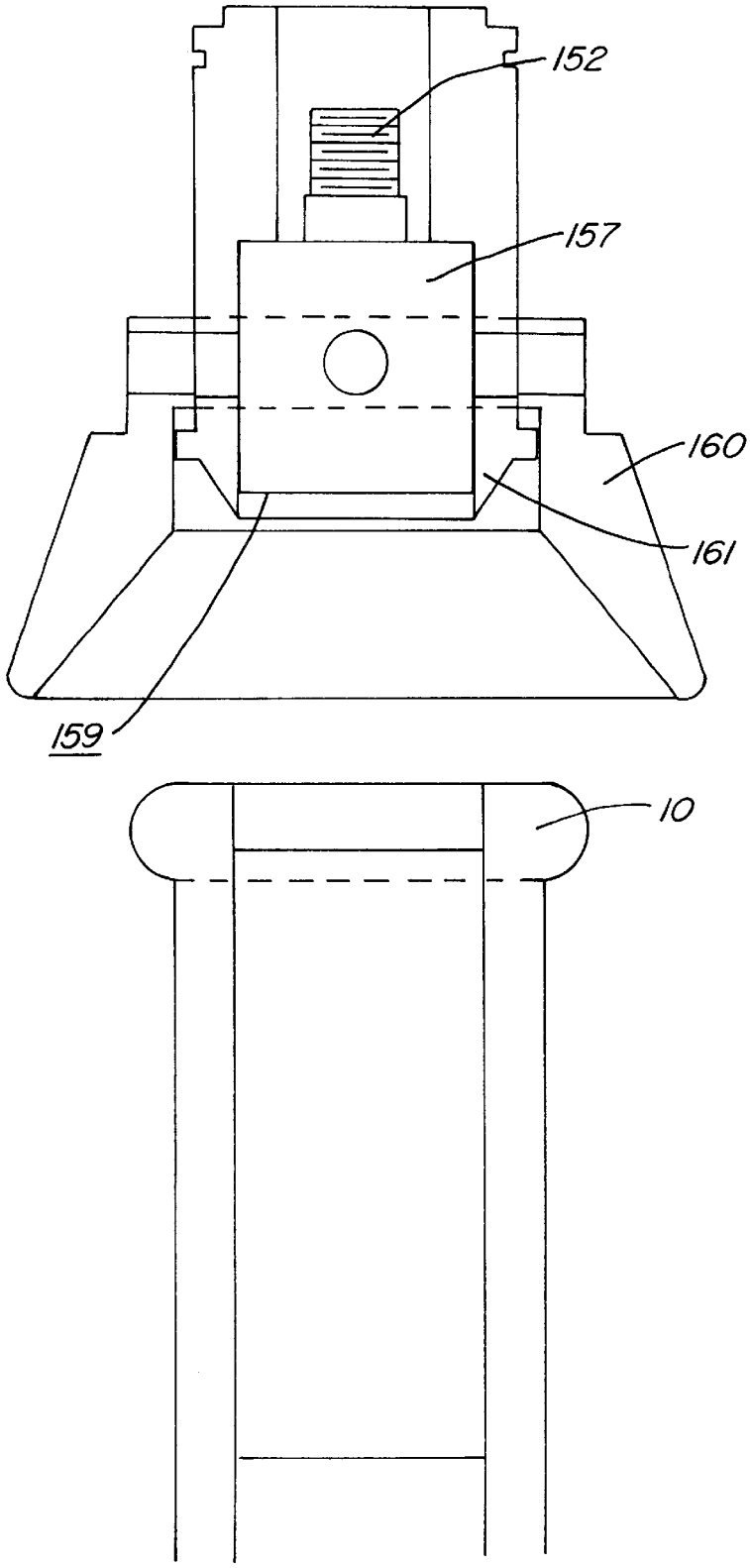
FIG. 12 is a side elevation view of the die truck assembly of FIG. 6 and the bottle neck and cork of FIG. 1.

Die truck assembly 50 also includes inner cone 161, as illustrated in FIG. 12, for further centering of the assembly with bottle. Inner cone 161 is a cylindrical shaft which is contained within the upper section of centering member 160. Inner cone 161 is in operable contact with die stem 152 and is able to move in a vertical direction within centering member 160. Contained within inner cone 161 is die 157.

Centering member 160 desirably includes a plurality of openings 162 to facilitate cooling of bottle neck 10 to hasten the solidification of molten seal material 14 therein to form seal 22. Centering member 160 includes retaining portion 164 which limits the downward movement of centering member 160 relative to die stem 152 and prevents it from separating from die stem 152. Inner wall 165 of centering member 160 is disposed around die 157 which is recessed from the edge of inner wall 165 to form the die cavity for making embossed seal portion 16.

Figure 14:
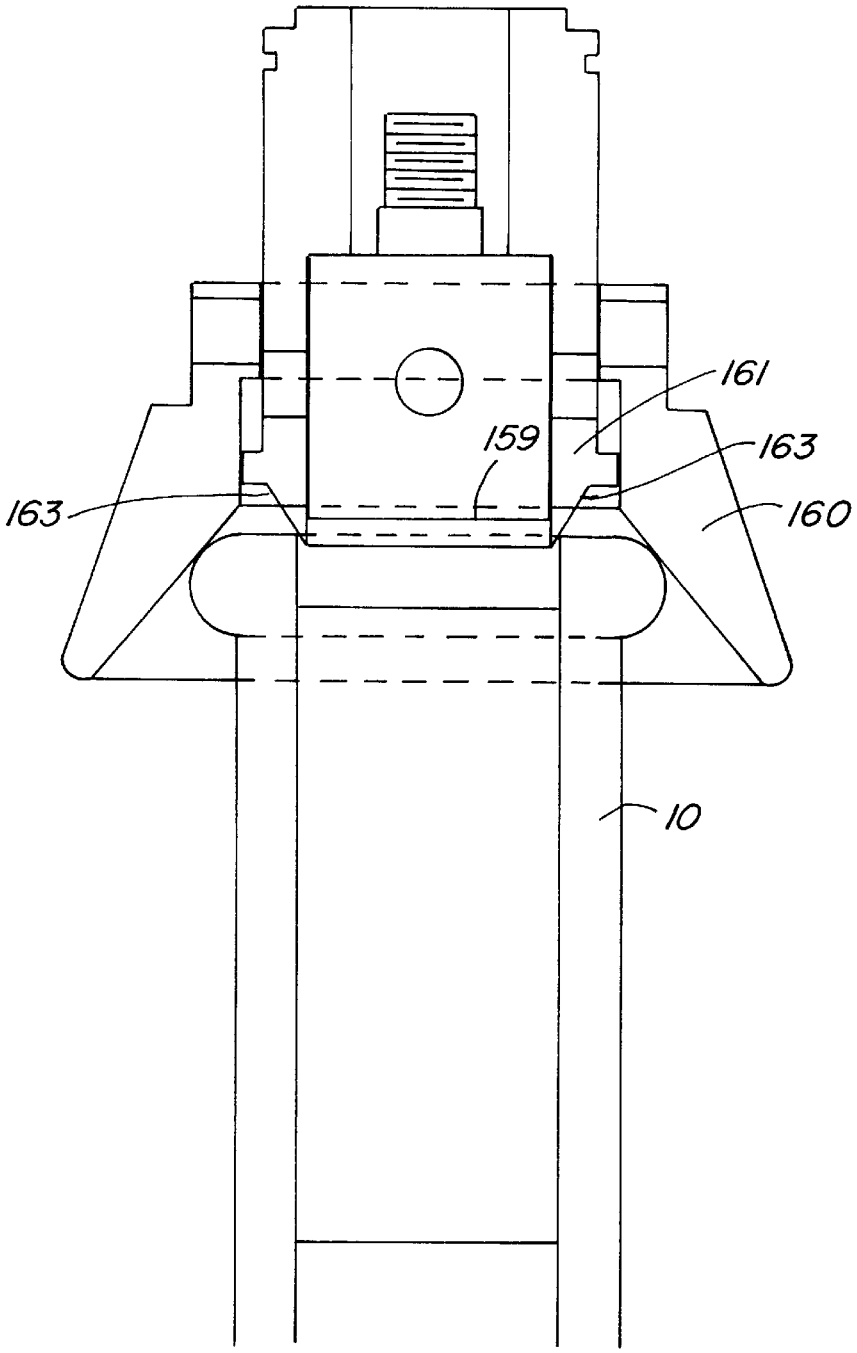
FIG. 14 is a side elevation view of the die truck assembly of FIG. 6 and the bottle neck and cork of FIG. 1 illustrating the further centering of the die truck assembly over the neck of the bottle.
Figure 15:
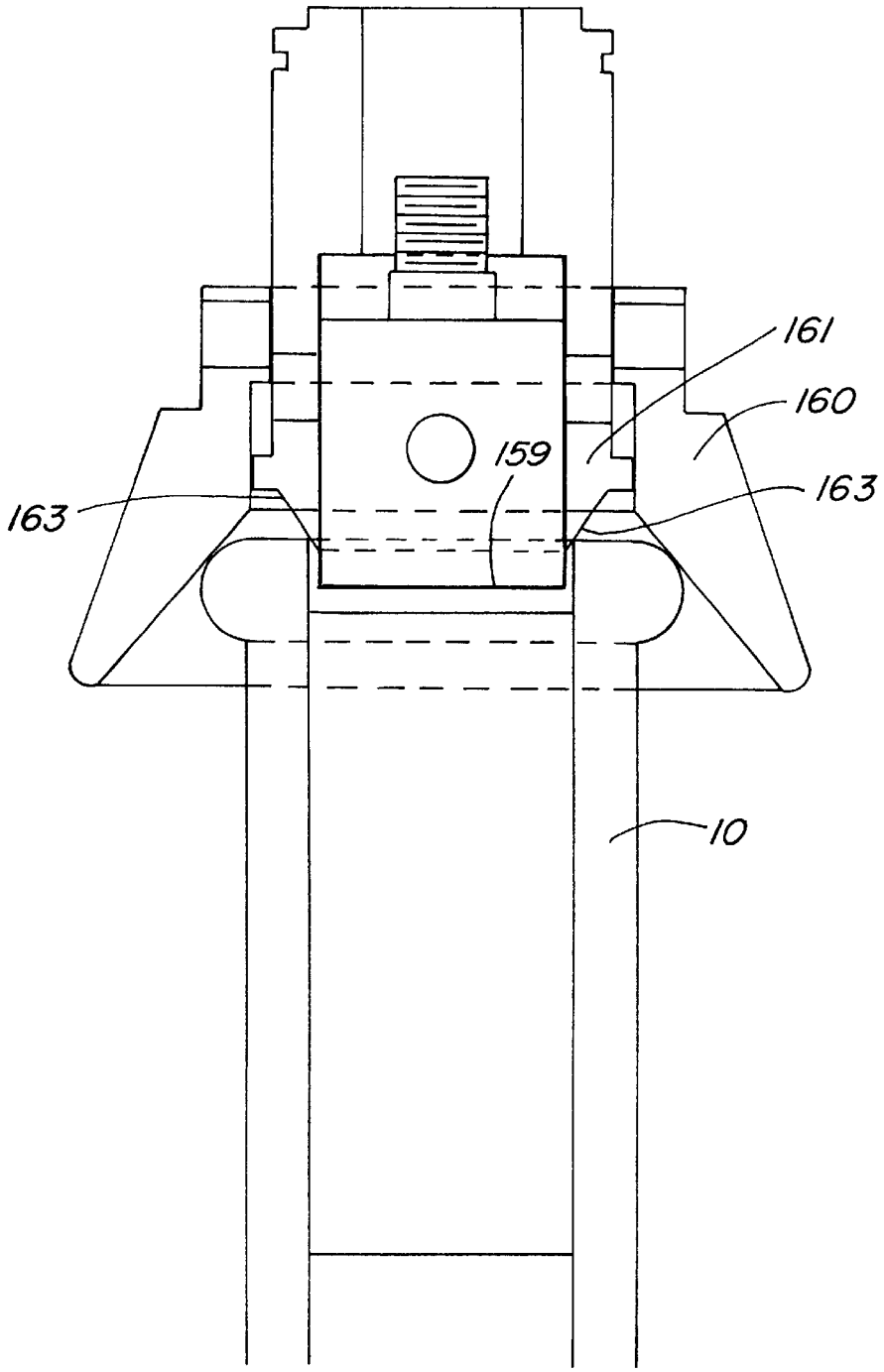
FIG. 15 is a side elevation view of the die truck assembly of FIG. 6 and the bottle neck and cork of FIG. 1 illustrating the insertion of the die surface of the die truck assembly into the neck of the bottle.

Engagement spring 166 is coupled between spring seat 150 on guide tube 130 and centering member 160 and inner cone 161. The compression of engagement spring 166 from its rest position shown in FIG. 8 allows centering member 160 to move upward relative to guide tube 130 and die stem 152. The upward movement also provides tolerance in movement of centering member 160 to adapt assembly 50 to bottles 66 having slightly varying heights. As best illustrated in FIGS. 13 through 15, the compression of engagement spring 166 and upward movement of centering member 160 is the initial step in a process culminating in contact between die surface 159 and molten seal material 22.

Figure 13:
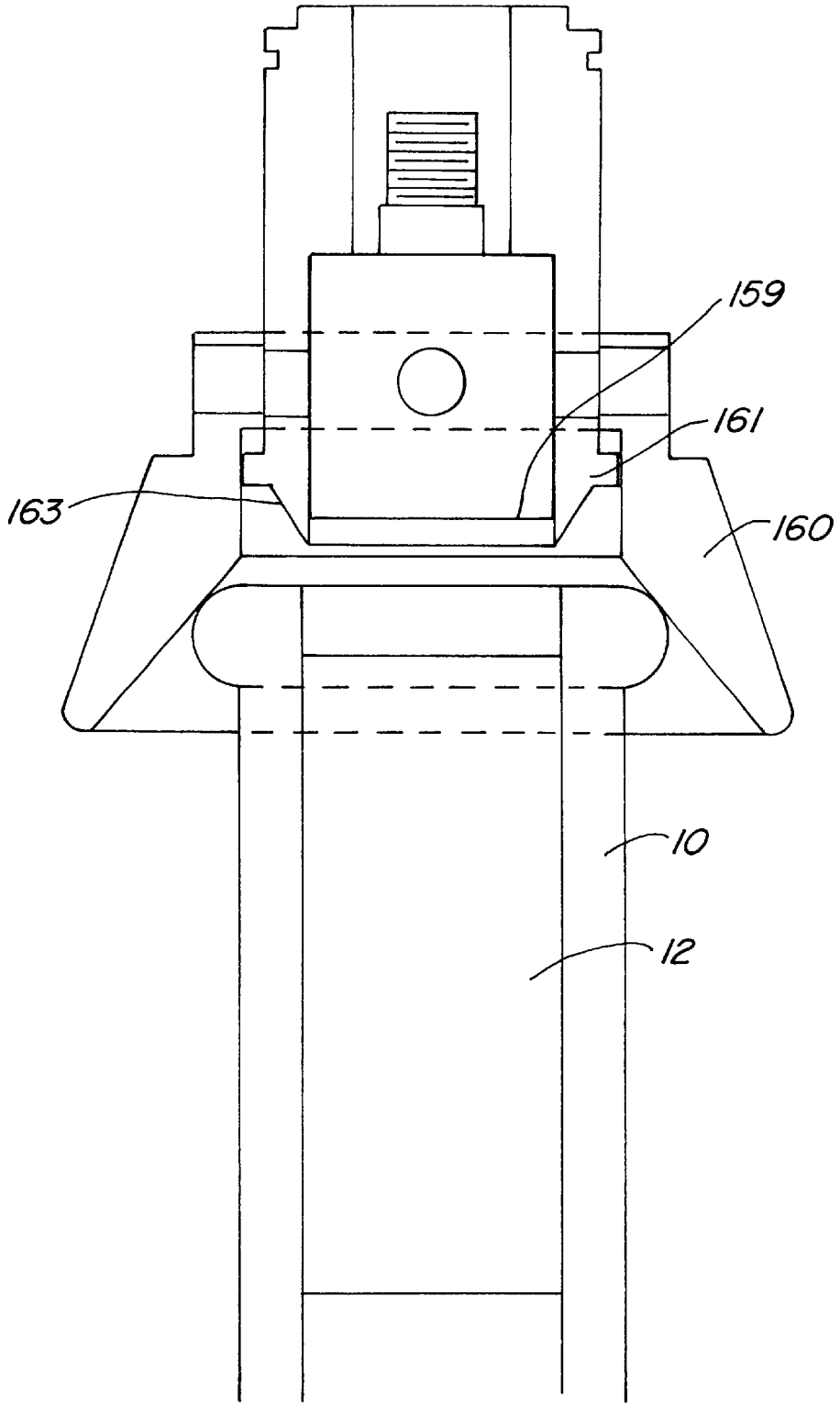
FIG. 13 is a side elevation view of the die truck assembly of FIG. 6 and the bottle neck and cork of FIG. 1 illustrating the initial centering of the die truck assembly over the neck of the bottle.

As centering member 160 is brought into contact with bottle neck 10, die truck assembly 50 is generally aligned with the bottle neck (FIG. 13). Further compression of engagement spring 166 causes inner cone 161 to lower itself into the cavity above cork 12 in bottle neck 10 (FIG. 14). Lower edges 163 of inner cone 161 are angled outward so that as the inner cone is lowered into bottle neck 10, the bottle neck becomes exactly centered below die truck assembly 50. As illustrated in FIG. 15, after inner cone 161 has centered assembly 50, die surface 159 is lowed from inside cylindrical inner cone 162 and brought into contact with molten seal material 22.

Die stem spring 170 is coupled between spring seat 150 on guide tube 130 and blocking member 158 on die stem 152. The compression of die stem spring 170 from its rest position as shown in FIG. 8 permits upward movement of die stem 152 relative to guide tube 130. This upward movement allows die stem 152 to adapt to corks 12 of slightly varying depths from the openings of necks 10 of bottles 66 so as to exert a generally consistent pressure on molten seal material 14 to form finished seal 22 regardless of cork depth.

Note that actuator spring 148, engagement spring 166, and die stem spring 170 may be relaxed but are typically in slight compression in the rest position shown in FIGS. 6–8 to bias the components of die truck assembly 50 in specific positions relative to each other.

Figure 9:
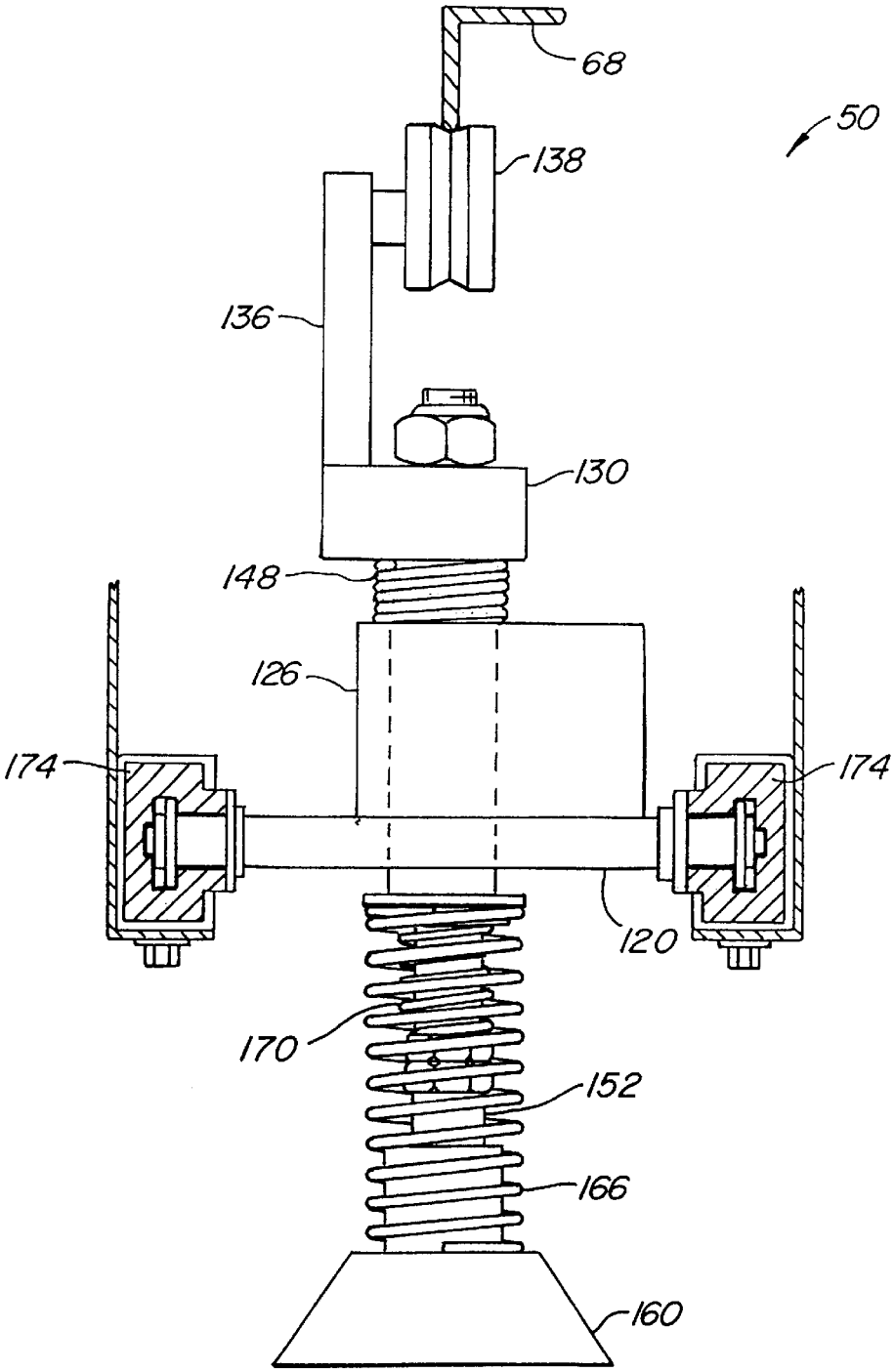
FIG. 9 is a side elevation view of the die truck assembly of FIG. 6 illustrating the compression of the actuator spring.
Figure 10:
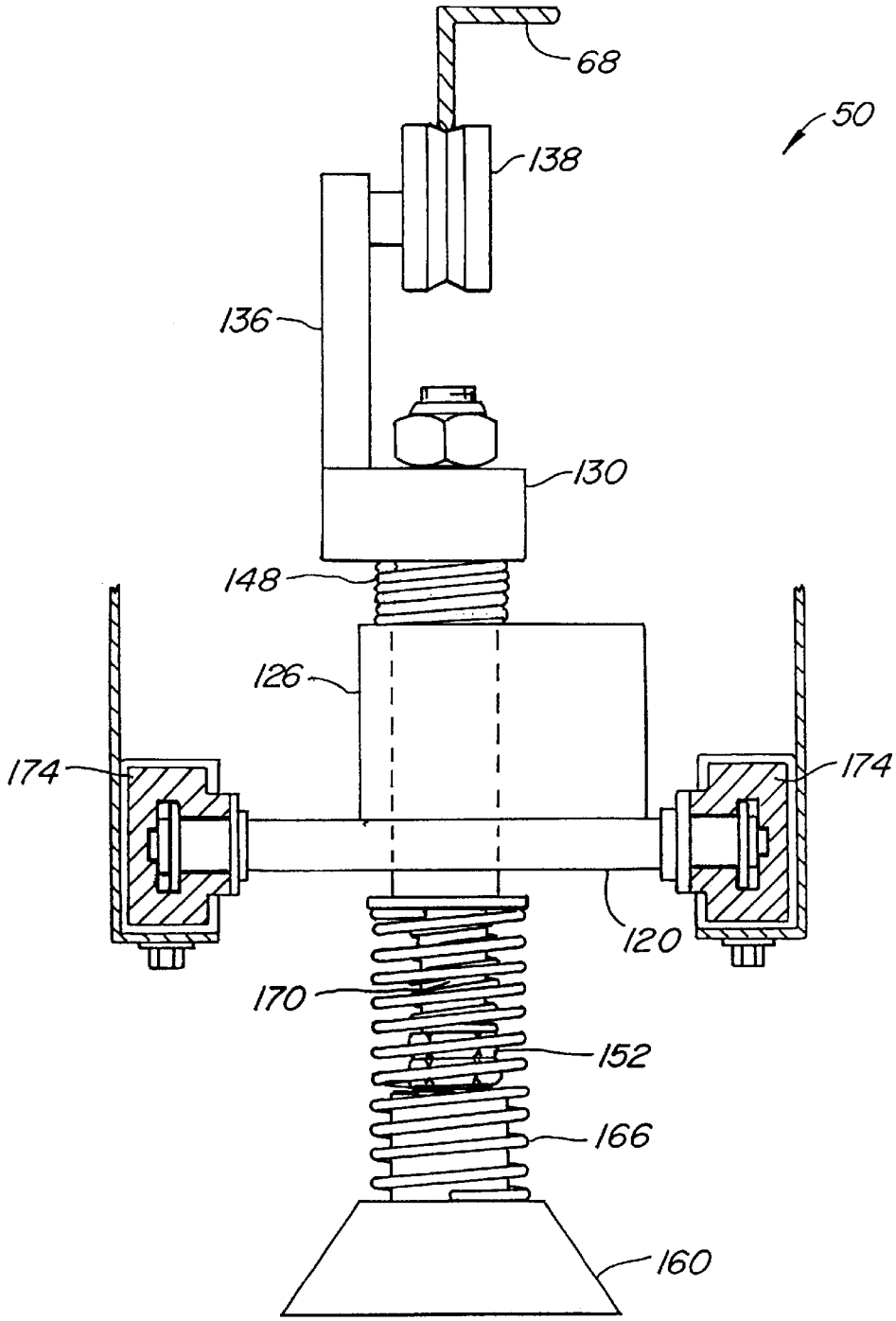
FIG. 10 is a side elevation view of the die truck assembly of FIG. 6 illustrating the compression of the engagement spring.
Figure 11:
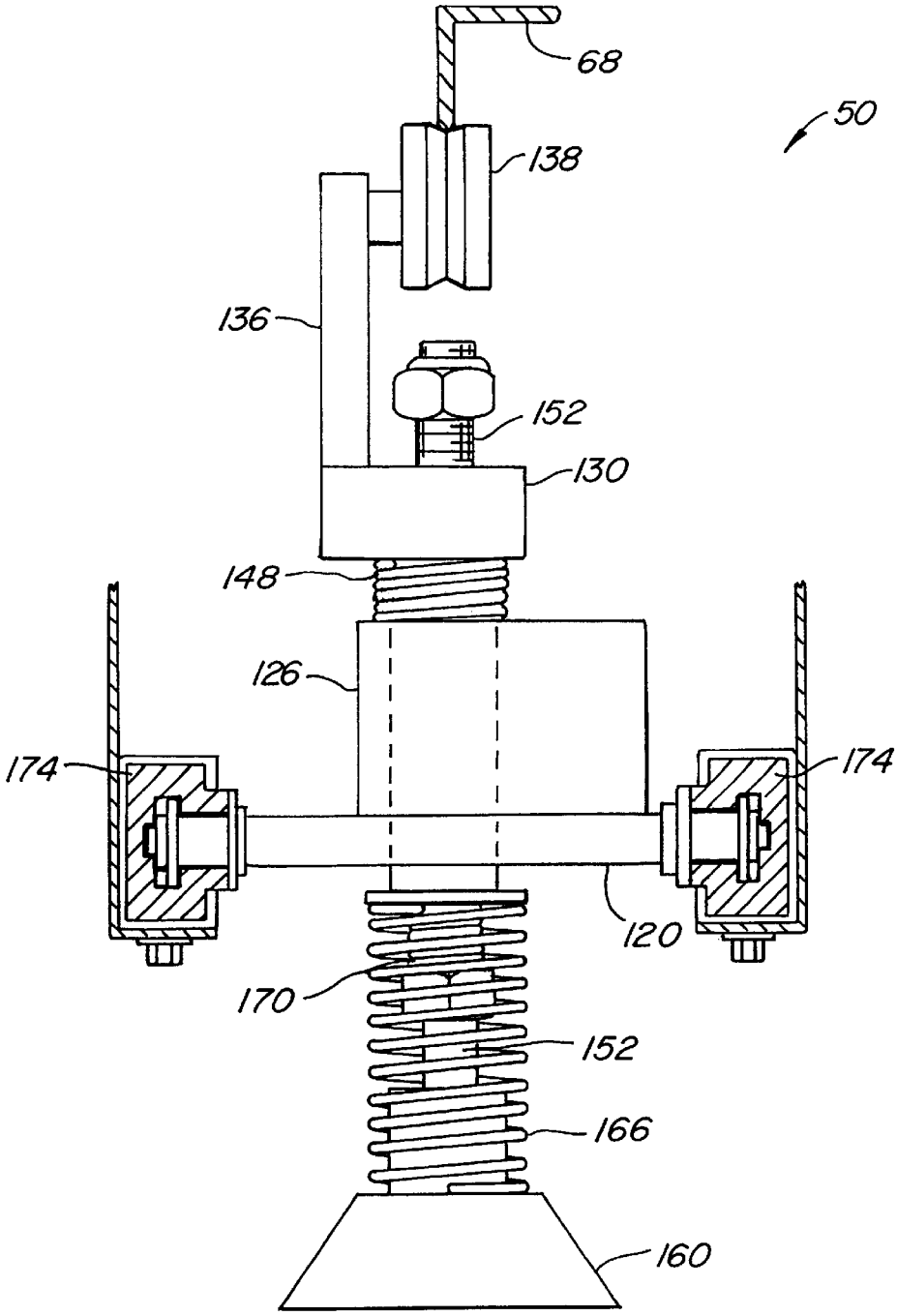
FIG. 11 is a side elevation view of the die truck assembly of FIG. 6 illustrating the compression of the die stem spring.

The triple telescoping action of die tuck assembly 50 is illustrated in FIGS. 9–11. Carrier plate 120 is attached to a pair of guide tracks 174 which are connected with drive chain 36 to travel around the path of the drive chain. In a preferred embodiment, apparatus 30 includes a pair of parallel drive chains 36 supporting the two sides of carrier plate 120 through the pair of guide tracks 174 and moving in unison to transport assemblies 50. For the purposes of the following discussion, carrier plate 120 serves as a reference for vertical movements of the various components of assembly 50. In FIG. 9 the offset portion of wheel track 68 along lower path portion 40 of drive chain 36 pushes actuator spring 148 against guide block 126. The downward movement of these components forming the actuation portion of assembly 50 causes die stem 152 and centering member 160 to move downward with guide tube 130.

When centering member 160 meets neck 10 of bottle 66, it is pushed upward by neck 10 and toward carrier plate 120 to compress engagement spring 166, which maintains the engagement between centering member 160 and bottle neck 10, as shown in FIG. 10. The upward movement of centering member 160 relative to die stem 152 causes inner cone 161 to protrude from inside centering member 160 and for die 157 to protrude from inside inner cone 161.

In FIG. 11, die stem spring 170 is compressed when die stem 152 is pushed upward by cork 12 and molten seal material 14 in bottle neck 10. The upward movement allows die stem 152 to adapt to corks 12 of slightly varying depths from the openings of necks 10, so as to exert a generally consistent pressure to form finished seal 22 regardless of cork depth.

After die truck assembly 50 is disengaged from bottle 66, the biasing forces of actuator spring 148, engagement spring 166, and die stem spring 170 return the components of assembly 50 to the rest position shown in FIGS. 6–8. In an alternative embodiment, actuator spring 148 is eliminated so that die truck assembly 50 provides a double telescoping action. Instead of pushing actuator wheel 138, bracket 136, and guide tube 130 downward to engage assembly 50 with neck 10 of bottle 66, bottle 66 is moved upward to meet assembly 50. In such a system, the third telescoping action of moving guide tube 130 downward to engage with the bottle neck is not needed.

Bottle Sealing Procedure

The bottle sealing process employing apparatus 30 of FIGS. 3–5 with die truck assembly 50 of FIGS. 6–11 is described as follows. Referring to FIGS. 3–5, drive motor 80 is turned on to drive chain 36 to move die truck assemblies 50. Assemblies 50 are transported by drive chain 36 to lower path portion 40.

Before assemblies 50 reach lower path portion 40, bottles 66 are fed through timing screw 76 to bottle conveyor 64 which are synchronized in movement with assemblies 50 to align necks 10 of bottles 66 with assemblies 50. The applicator 70 is activated to introduce an amount of the molten seal material into the cavity of each bottle 66 before it is transferred to bottle conveyor 64. When bottle 66 is aligned with die truck assembly 50, the offset portion of wheel track 68 on upper support frame 32 pushes the components of assembly 50 except carrier plate 120 and guide block 126 downward to engage the assembly with bottle neck 10. At this time, the seal material in bottle neck 10 is sufficiently molten to be impressed but may be cooled using cooling nozzles 62 so that it will retain the impression created by the die surface image.

The triple telescoping action provided by actuator spring 148, engagement spring 166, and die stem spring 170 of assembly 50 maintains the engagement between centering member 160 and bottle neck 10 along lower path portion 40 of travel of the assembly. A generally consistent pressure is exerted by the die surface 159 of assembly 50 on molten seal material to form finished seal 22, as illustrated in FIGS. 9–11. The molten seal material is sufficiently cooled so that the embossed surface 20 thereon is preserved upon separation of the die surface 159 from embossed surface 20, and the heat of the molten seal material in the bottle cavity does not cause melting of embossed surface 20.

During the engagement of die truck assemblies 50 with bottle necks 10, the offset portion of wheel track 68 keeps the actuation portion of each assembly in the downward position, thereby maintaining continued contact of die 157 with embossed seal portion 16 during the formation of finished seal 22 in bottle neck 10. This minimizes disturbance of the embossed image on the seal to avoid "blocking" of the die image on die 157 with seal residue by premature movement of the die surface 159 and the embossed surface on the seal.

At the end of lower path portion 40, wheel track 68 exits the offset portion and allows springs 148, 166, and 170 to raise the actuation portions of die truck assemblies 50 in a generally vertical direction to disengage them from bottles 66, as shown in FIGS. 3 and 5.

The methods and apparatus of the present invention permit the sealing of corked bottles at ambient temperature. The formation of the embossed seal is initiated by injecting molten seal material into the cavity above the cork in the neck of the bottle. While contact is maintained between the die surface 159 and the top layer of the molten seal material, an image is created on the seal material. Moreover, it is possible to form a seal with a "squeeze-up" finish having a hand-made look by squeezing up the molten seal material around the edge. The amount of squeeze up can be controlled by varying the temperature and/or volume of molten seal material 14 applied in the cavity of the bottle neck.

While a preferred embodiment of the present invention has been disclosed by way of example, it is evident that modifications and adaptations of that embodiment will occur to those skilled in the art. It is to be expressly understood that such modifications and adaptations are within the spirit and scope of the present invention, as set forth in the following claims.

What is claimed is:

1. An automated method of forming a seal over a cork in a necked bottle as the bottle moves along an automated bottle track using a die with an image bearing die surface contained within a seal embossing mechanism, the method comprising:

providing a molten seal material which is in a molten state outside of the bottle;

introducing the molten seal material in the molten state from outside the bottle into the cavity above the cork in the neck of the bottle;

superimposing the image bearing surface of the seal embossing mechanism over the mouth of the bottle containing the molten seal material;

centering the top of the bottle relative to the seal embossing mechanism;

extending a die surface having a die image from the seal embossing mechanism into contact with the surface of the molten seal material;

motivating the seal embossing mechanism along an automated seal track coincident with the movement of the bottle along the automated bottle track with an image bearing die surface in contact with the molten seal material until the molten material has cooled so that the seal impression will be retained by the sealing material; and retracting the image bearing die surface away from the surface of the cooled molten seal material.

2. The method of claim 1 wherein the molten seal material comprises a molten thermoplastic material.

3. The method of claim 1 wherein the seal embossing mechanism includes a centering cone, and wherein the centering step includes lowering the centering cone over the neck of a bottle so as to generally center the mouth of the bottle with the seal embossing mechanism.

4. The method of claim 1 wherein the seal embossing mechanism includes a circular centering/sealing piston, and wherein the centering step includes extending the circular centering/sealing piston into the mouth of the bottle so as to fully center the mouth of the bottle below the seal embossing mechanism.

5. The method of claim 4 wherein the extending step includes lowering the image bearing die surface through the circular centering/sealing piston into contact with the surface of the molten seal material in the neck of a bottle.

6. The method of claim 5 wherein the retracting step includes raising the image bearing die surface away from the mouth of the bottle through the circular centering/sealing piston.

7. An automated method of forming a seal over a cork in a necked bottle, the method comprising:

providing a molten seal material which is in a molten state outside of the bottle;

introducing the molten seal material in the molten state from outside the bottle into a cavity above the cork in the neck of the bottle;

extending a die surface into contact with the surface of the molten seal material;

maintaining contact with the molten seal material until the molten material has cooled; and retracting the image bearing die surface away from the surface of the cooled molten seal material.

* * * * *